US005091243A

United States Patent [19]

Tolbert et al.

[11] Patent Number: 5,091,243

[45] Date of Patent: Feb. 25, 1992

[54] FIRE BARRIER FABRIC

[75] Inventors: Thomas W. Tolbert, Fort Mill; Pamela J. Jaco, Rock Hill, both of S.C.; Jeffrey S. Dugan, Charlotte, N.C.; James E. Hendrix, Spartanburg, S.C.

[73] Assignee: Springs Industries, Inc., Fort Mill, S.C.

[21] Appl. No.: 333,174

[22] Filed: Apr. 4, 1989

[51] Int. Cl.[5] ..... B32B 7/00

[52] U.S. Cl. ..... 428/253; 427/393.3; 427/404; 428/229; 428/245; 428/257; 428/260; 428/263; 428/246; 428/305.5; 428/373; 428/402; 428/408; 428/920; 428/921

[58] Field of Search ..... 428/245, 247, 254, 255, 428/262, 289, 290, 305.5, 373, 408, 920, 921, 229, 253, 263, 402, 246; 427/393.3, 404

[56] References Cited

U.S. PATENT DOCUMENTS

| | | | |
|---|---|---|---|
| 2,280,135 | 4/1942 | Ward | 250/141 |
| 3,053,676 | 9/1962 | Higbee | 106/148 |
| 3,913,309 | 10/1975 | Chiarotto | 57/144 |
| 3,916,057 | 10/1975 | Hatch et al. | 106/15 FP |
| 3,934,285 | 1/1976 | May | 5/345 R |
| 4,216,261 | 8/1980 | Dias | 428/35 |
| 4,226,907 | 10/1980 | Sienkowski et al. | 428/288 |
| 4,282,276 | 8/1981 | Smith | 428/35 |
| 4,282,284 | 8/1981 | George | 428/251 |
| 4,444,825 | 4/1984 | Vanderstukken et al. | 428/215 |
| 4,463,465 | 8/1984 | Parker et al. | 5/459 |
| 4,500,593 | 2/1985 | Weber | 428/257 |
| 4,509,559 | 4/1985 | Cheetham et al. | 138/121 |
| 4,569,878 | 2/1986 | Barrall et al. | 428/182 |
| 4,572,862 | 2/1986 | Ellis | 428/245 |
| 4,623,583 | 11/1986 | Mischutin | 428/242 |
| 4,663,204 | 5/1987 | Langham | 428/12 |
| 4,670,327 | 6/1987 | Weber | 428/257 |
| 4,755,407 | 7/1988 | Mortensen et al. | 428/36 |
| 4,756,945 | 7/1988 | Gibb | 428/124 |
| 4,778,544 | 10/1988 | Jones et al. | 156/60 |

*Primary Examiner*—James J. Bell
*Attorney, Agent, or Firm*—Bell, Seltzer, Park & Gibson

[57] ABSTRACT

A fire-resistant fabric suitable for use as a flame barrier comprising a flame durable textile fabric substrate formed of corespun yarns, the yarns comprising a core of flame resistant filament and a sheath of staple fibers, and an intumescent coating carried by one surface of the textile fabric substrate. In normal use, the fabric is flexible and conformable and has good air porosity. When exposed to high temperature and/or a flame, however, the intumescent coating reacts and swells to form a char which closes the pores or interstices of the fabric to thus prevent flame or hot gases from penetrating therethrough.

43 Claims, 2 Drawing Sheets

FIRE BARRIER FABRIC

FIELD AND BACKGROUND OF THE INVENTION

This invention relates to the structure and manufacture of a protective fabric suitable for use as a heat and flame barrier. More particularly, the fabric may be used to prevent the combustion of flammable materials by using the fabric as a barrier between the heat source and any flammable materials.

Various types of protective fabrics have been developed for use in applications in which fabric covered articles (e.g., upholstered articles or office panels) must be capable of withstanding exposure to heat and/or flame without combustion. For example, in upholstered aircraft seating, a heat resistant protective barrier fabric is typically provided between the outer upholstery fabric and the underlying flammable foam cushion to retard or prevent combustion of the cushion in the event of fire. Note, for example, U.S. Pat. No. 4,463,465 to Parker et al which discloses a barrier fabric which comprises an aramid fabric substrate and an outer aluminum foil layer. The use of an aluminum foil layer, however, has several drawbacks, namely the fabric has limited breathability and the cushioning aspects of the upholstered article are reduced.

U.S. Pat. No. 4,509,559 to Cheetham et al discloses an exemplary fire-resistant fabric used as a protective cover for hoses employed to transport inflammable liquids. The fabric comprises an innermost layer of a thermally intumescent material, an intermediate layer of a fabric impregnated with alumina trihydrate and an outermost polished metal sleeve. This fabric is resistant to fire but has very limited flexibility and formability, making it unsuited for many applications, such as with upholstery.

U.S. Pat. No. 4,569,878 to Barrall et al discloses a fire-resistant laminate material, useful as office partitions, comprising a series of layers of woven and non-woven synthetic material and glass which are bonded together with an intumescent composition comprising a metal oxide, calcium silicate and phosphoric acid. This fabric also has limited flexibility and breathability.

Another technique for producing a fire-resistant fabric for use as a flame barrier is to coat the fabric with a fire-resistant compound. Exemplary compounds include those based on an inorganic hydrated compound such as hydrated alumina, hydrated magnesia, magnesium oxychloride, hydrated zinc borate and hydrated calcium borate. Coatings of this type, however, leave spaces between the fibers of the fabric. These spaces or interstices potentially allow hot gases and/or flames to penetrate therethrough and ignite the underlying flammable material.

SUMMARY OF THE INVENTION

The present invention provides a flame durable fire barrier fabric which is resistant to high temperature fires, is lightweight and breathable and is highly conformable and flexible. The fabric of the present invention includes a flame durable textile fabric substrate formed of corespun yarns and an intumescent coating applied to one surface of the textile fabric substrate. The corespun yarns comprise a core of a flame resistant filament, such as fiberglass filaments, and a sheath of staple fibers. The intumescent coating, when exposed to heat, swells and forms an insulating char, filling the interstices between the yarns, choking off the flames and thereby making the fabric substrate resistant to melting or burning. The coating does not adversely affect flexibility and breathability during normal use, and the fabric substrate can be easily conformed to the underlying flammable material.

BRIEF DESCRIPTION OF THE DRAWINGS

Some of the features and advantages of the invention having been stated, others will appear as the description proceeds, when considered in conjunction with the accompanying drawings, in which.

DETAILED DESCRIPTION OF THE INVENTION

The present invention will be described more fully hereinafter with reference to the accompanying drawings, in which preferred embodiments of the invention are shown. This invention can, however, be embodied in many different forms and should not be construed as limited to the embodiment set forth herein; rather, applicants provide these embodiments so that this disclosure will be thorough and complete, and will fully convey the scope of the invention to those skilled in the art.

Figure 1:
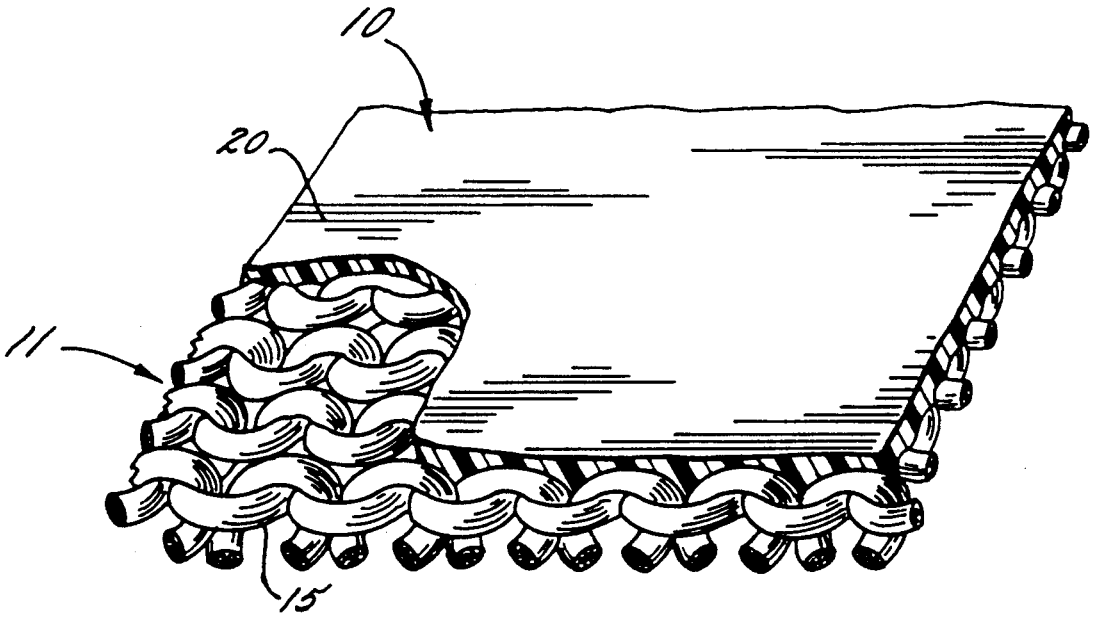
FIG. 1 is an enlarged detailed isometric view of a portion of a fire-resistant fabric having an intumescent coating thereon in accordance with the invention, with the layers broken away to more clearly reveal the fabric construction.
Figure 3:
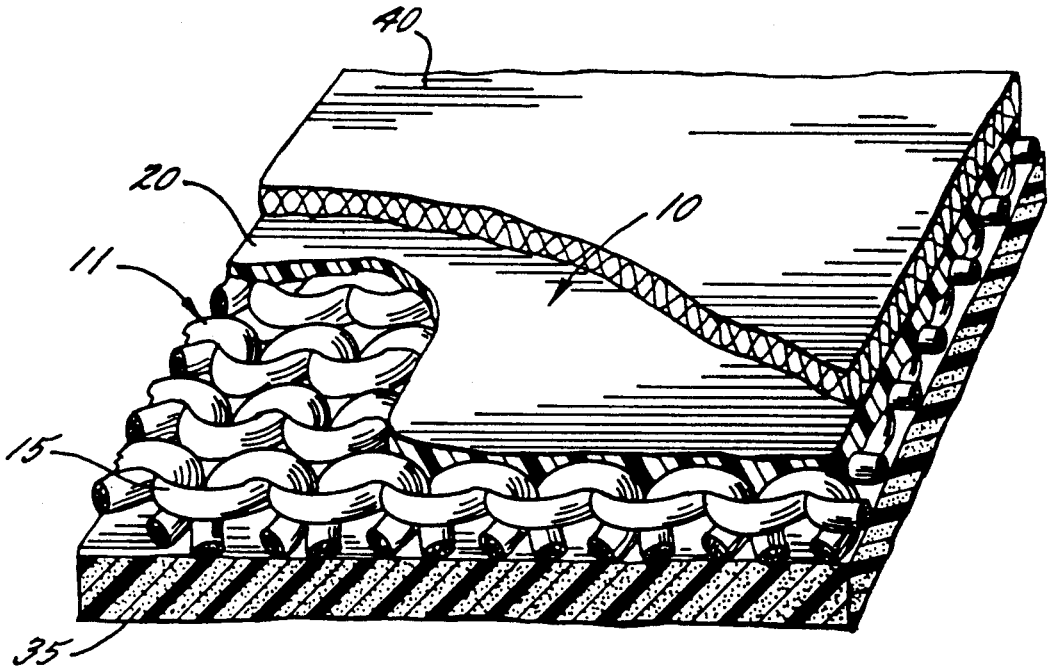
FIG. 3 is an enlarged detailed isometric view of the fire-resistant fabric shown in FIG. 1, located between an upholstery fabric outer layer and an underlying flammable foam layer.

As shown in FIG. 1, the fire-resistant barrier fabric 10 of the present invention comprises a textile fabric substrate 11 formed of yarns 15 and an intumescent coating 20 on one surface of the fabric substrate 11. As shown in FIG. 3, the fire-resistant fabric 10 may be used as a flame barrier by locating it between an underlying flammable layer 35 and a decorative fabric outer layer 40 with the intumescent coating layer 20 preferably contacting the outer layer 40 and facing the flame source.

The textile fabric substrate 11 is flame durable and at least some portion of the fabric remains intact upon exposure to a flame so that the fabric substrate 11 forms a base or support for the intumescent coating layer 20. The fabric substrate 11 may be of any of the various fabric constructions, such as fabrics of knitted, woven, non-woven, braided, warp lay, and scrim reinforced web construction. A knitted construction is preferred because of its ease and inexpensiveness of construction and such a construction has excellent flexibility and conformability properties, and is breathable because of its inherent porosity.

The yarns 15 of these fabrics are of corespun construction, the production of which is described, for example in co-pending, commonly assigned, U.S. patent application Ser. No. 318,239, filed on Mar. 3, 1989 now U.S. Pat. No. 4,921,756. One particularly suitable corespun yarn construction comprises a filament core of from about 20% to 40% of the total weight of the corespun yarn, while the sheath of staple fibers comprise from about 80% to 60% of the total weight of the corespun yarn. The filaments of the core may be fibers of glass, polybenzimidazole, polyimides, polyarenes, various metals, Kevlar®, Nomex®, and carbon or carbonizable compounds. The core may also be blends of these fibers or may be of a multicore construction where a combination of the fibers are used. Fiberglass is preferred because it is an inexpensive, but flame durable filament. The staple fibers of the sheath surrounding the core may be fibers of either natural or synthetic material, such as cotton, polyester, rayon, wool, nylon, acrylic, modacrylic, acetate or blends of these fibers.

Referring to FIG. 1, a textile fabric substrate 11 of knitted construction is illustrated. The knitted construction is characterized by the intermeshing of loops of the yarns 15. The set of yarns may consist of a single yarn (i.e. weft knit) or groups of yarns (i.e. warp knit). As shown in FIG. 1, the loops 15 of yarn are formed by a single weft thread and are formed across the width of fabric. Such a construction is porous and breathable.

The flame resistant barrier fabric 10 of this invention is produced by applying an intumescent coating 20 to one surface of the textile fabric substrate 11. The intumescent coating is preferably applied as a lightweight and porous foam or froth using conventional coating techniques such as a knife coater, a roll coater, spray coating, calendering, transfer coating or screen printing. Various intumescent compounds are known and one particular suitable class of intumescent compounds comprises a source of carbon (i.e. a carbonific), a catalyst, and a source of non-flammable gas (i.e. a foaming or blowing agent). Exemplary carbonifics include carbohydrates, proteins or polyfunctional alcohols such as starch, casein or pentaerythritol. On exposure to flame, the catalyst causes the carbonific compound to swell and char. Exemplary catalysts include inorganic acids such as boric, phosphoric, or sulfuric acid, or may include compounds which on decomposition form an inorganic acid such as mono- or diammonium phosphates, melamine, and urea. The source of non-flammable gas for foaming the intumescent coating may be provided by the catalyst, for example if melamine is used as the catalyst, or alternatively be provided by a compound which upon exposure to a flame evolves the gas such as ammonia, carbon dioxide or hydrogen chloride. The intumescent composition may be compounded with binders and thickeners and the like to aid in the specific application of the coating. Additionally, conventional flame retardant fillers such as alumina trihydrate, silicates, kaolin, gypsum and hydrated clay may be added.

In everyday use, the barrier fabrics of the present invention are lightweight and flexible and are breathable because of their porosity which is one of the results of applying the coating as a porous foam and not as a non-porous film. The porosity and breathability of a fabric is expressed in terms of the "air permeability" of the fabric. Air permeability is measured in accordance with ASTM Standard Test Method D737 for Air Permeability of Textile Fabrics. The rate of flow through a known area of fabric is adjusted to secure a prescribed pressure differential between the two surfaces of the fabric in the test area and from this rate of flow the air permeability of the fabric is determined. Thus, using a 4 mm calibration orifice through which air is blown at a rate of 3.73 cubic feet per minute, the coated fabric of the present invention has an air permeability of about 1 to 300 cubic feet per minute, with from about 2 to 80 cubic feet per minute being typical, and a value of from about 10 to 30 cubic feet per minute being preferred.

The barrier fabrics are particularly suitable as flame barriers in upholstered articles since the fabric flame barrier can easily be conformed to the shape of the article, and its excellent breathability does not detract from the desirable aesthetic properties of the decorative outer fabric. In particular, the air permeability of the barrier fabric assures good air circulation for comfort. The air permeability of the barrier fabric is also particularly important when the barrier is used with cushioned upholstered articles used for seating. Because of the air permeability of the flame barrier fabric, air is free to escape from the cushion when it is compressed. Thus, the fabric avoids the hard and uncomfortable "balloon" effect that is characteristic of most prior art air impermeable flame barrier fabrics.

However, when the barrier fabric of the present invention is exposed to high temperature and/or a flame, the intumescent compound reacts and swells to form a char which closes the pores of the compound itself and fills the pores or interstices between the yarns. The char is substantially incombustible and has cellular characteristics. The char thus acts as a flame barrier and limits the penetration of flames and hot gases through the fabric to ignite the underlying flammable material. The corespun yarns also contribute to the flame resistance properties of the fabric. The flame resistant core filaments remain intact on exposure to a flame and along with the charred remains of the sheath fibers, provide a lattice or support for the intumescent coating.

Figure 2:
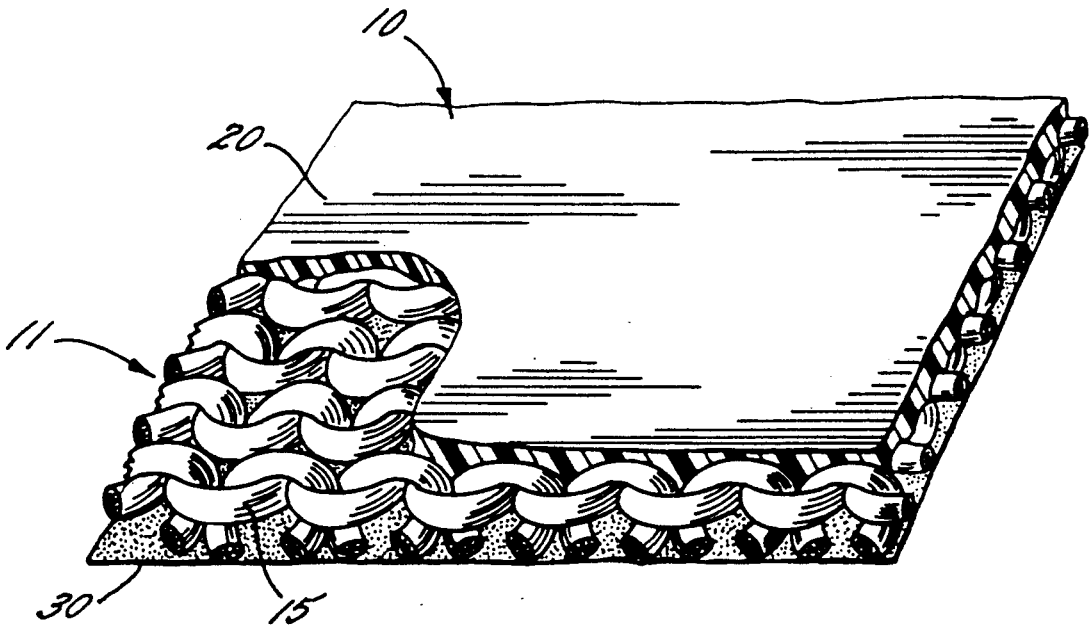
FIG. 2 is an enlarged detailed isometric view similar to FIG. 1 showing a fire-resistant fabric having an intumescent coating on one surface thereof and a reflective paint coating on the opposite surface thereof.

As illustrated in FIG. 2, a reflective paint coating 30 also may be applied to the barrier fabric on the surface opposite that of the intumescent coating 20. This layer serves to reflect radiant heat from the underlying flammable material. Additionally, this layer does not significantly effect the air permeability and the flexibility of the barrier fabric. The reflective paint coating 30 is preferably a metallic paint and contains metal flake pigments and a flame-durable binder. A metal flake pigment with good leafing properties and good reflecting properties is preferred. Exemplary metal flake pigments having high reflectivity include aluminum, brass, copper, gold, nickel and silver. Aluminum is preferred because of cost and an exemplary aluminum flake is LSB-547 Leafing Aluminum Flake available from Reynolds Metal Company of Richmond, Virginia. The flame-durable binder is preferably a silicone alkyd resin and a suitable one is Kelsol 3970 Modified Silicone Alkyd Resin sold by Spencer-Kellogg Company of Hightstown, New Jersey. This resin when exposed to a flame reacts in a manner so that the metal flakes of the pigment intimately bind to the substrate and to each other. If it is desirable to use water to adjust the viscosity of the paint coating, aqueous ammonia may be included to improve the compatibility of the binder with the water.

Suitable reflective metal paints also may include Pyromark 2500 and Pyromark 800 aluminum paint available from Tempil Division of Big Three Industries, Inc. of South Plainfield, New Jersey and Lo-Mit-1 aluminum paint available from Solar Energy Corporation of Princeton, New Jersey. The paint coating 30 is applied by conventional techniques and may be dried at high temperatures and long exposure to improve adherence of the paint coating to the fabric layer. Typically about 300° F. for 60 seconds is optimum to adhere the paint coating to the fabric layer to ensure maximum abrasion resistance.

The fire barrier fabric of the invention is particularly useful as a flame barrier for use in upholstered articles and building materials for offices such as wall coverings, wall panels, office panel partitions, ceiling panels, floor coverings and the like, bedroom articles such as mattress and pillow ticking, mattress and pillow covers, draperies, tenting, awnings, field fire shelters and sleeping bag covers. The fabric is lightweight, breathable and flexible and can easily be molded and formed so as to conform to oddly-shaped upholstered articles and building materials such as when laminating the fabric thereto.

In operation, the intumescent coating 20 is applied as a foam or froth, and is applied to the textile fabric substrate 10 by conventional coating techniques as described above. The coating is applied a rate of about 0.25 to 20 ounces (dry) per square yard, with a rate of from about 2.0 to 3.5 ounces (dry) per square yard being preferred. The coated substrate is then dried and the coating cured. The coated substrate, with or without the reflective paint coating 30, and the decorative surface fabric or upholstery layer 40 may be bonded together using conventional adhesives or using the inherent tackiness and adhesive characteristics of the intumescent coating. In the latter bonding technique, the intumescent coating is only partially cured so that the coating is tacky, and then the substrate and the upholstery layer 40 are fusion bonded together using pressure followed by the intumescent coating being completely cured at low temperature. An underlying flammable layer 35 such as a foam layer, non-woven batting layer, fiberfill layer or feather layer also may be supplied wherein the surface of the textile fabric substrate 10 opposite that of the intumescent coating and the flammable layer 35 are bonded together using conventional adhesives.

Figure 4:
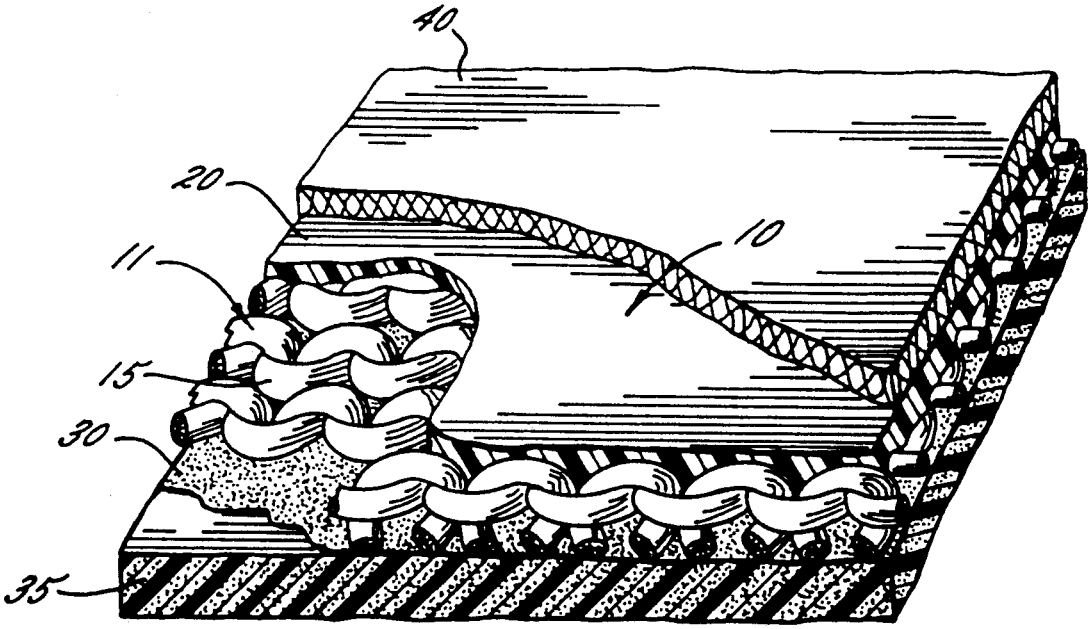
FIG. 4 is an enlarged detailed isometric view of the fire-resistant fabric shown in FIG. 2, located between an upholstery fabric outer layer and an underlying flammable foam layer.

Thus, as shown in FIG. 3, the fabric may be used as a barrier in upholstered articles wherein the fabric 10 is placed between the underlying flammable layer 35 such as a polyurethane foam layer and the upholstery layer 40 with the intumescent coating facing towards the flame source and away from the flammable layer 35. As shown in FIG. 4, a fabric with the intumescent coating 20 and a reflective paint coating 30 in contact with the flammable layer 35 also may be used as a barrier between the flammable layer 35 and an upholstery layer 40.

Several coated fabrics are illustrated by the following examples, which are to be considered as illustrative of the present invention. It should be understood that the invention is not limited to the specific details of the examples.

EXAMPLES

Knitted fabrics having a corespun construction comprising a fiberglass filament core and a cotton staple sheath were formed using conventional techniques. These fabrics were coated with an intumescent coating and in Example 2 the fabric was additionally coated with a reflective paint coating. After coating, a polyurethane foam pad was stapled thereto with the intumescent coating facing away from the foam layer/substrate interface. These fabrics were compared to a standard fabric formed from noncoated knitted glass/cotton corespun yarns. The test method consisted of exposing the fabric with the intumescent coating layer closest to a flame from a Bunsen burner at 1200° F. for 2.5 minutes. The samples were visually evaluated for the extent of damage to the underlying polyurethane foam pad.

EXAMPLE 1

A knitted corespun yarn fabric was coated with an intumescent coating comprising the following:

| | % by weight | oz/sq yd dry solids fabric |
|---|---|---|
| Vinylidene chloride/ acrylic latex binder | 26.69 | 1.750 |
| Sodium lauryl sulfate foaming agent | 0.76 | 0.050 |
| Sodium salt of n-octadecyl sulfosuccinimate | 0.04 | 0.003 |
| Melamine blowing agent | 2.20 | 0.144 |
| Pentaerythritol carbonific compound | 4.58 | 0.300 |
| Phosphorus pentoxide flame retardant | 13.72 | 0.900 |
| Guar gum thickener | 0.92 | 0.060 |
| Water | 51.09 | — |

The coating was frothed by placing the coating composition in a blender and mixing at a high speed. The frothed coating composition with a foam ratio of 2.5 to 1 was then applied to one surface of the fabric and dried by heating. The dried coating on the fabric had a dry solids weight of 3.2 oz/sq yd.

EXAMPLE 2

The intumescent composition coated fabric of Example 1 was coated on the opposite surface with a 0.5 oz/sq yd (dry solids weight) coating of a reflective paint comprising the following:

| | % by weight | oz/sq yd dry solids fabric |
|---|---|---|
| Water-compatible leafing aluminum flake | 17 | 0.085 |
| Water-reducible silicone alkyd resin | 34 | 0.170 |
| Aqueous ammonia | 7 | 0.035 |
| Water | 42 | — |

The standard fabric had extensive damage to the underlying foam pad, whereas the fabrics of Examples 1 and 2 had a slight charring of the foam pad only at the point directly above the flame. Additionally, the fabrics of examples 1 and 2 had good strength and flexibility.

In the drawings and specification, there have been disclosed preferred embodiments of the invention and, although specific terms are employed, they are used in a generic and descriptive sense only and not for the purpose of limitation, the scope of the invention being set forth in the following claims.

That which we claim is:

1. A fire-resistant fabric suitable for use as a flame barrier, and comprising: a flame durable textile fabric substrate formed of corespun yarns, said yarns comprising a core of a flame resistant filament and a sheath of staple fibers, and an intumescent coating carried by one surface of said textile fabric substrate.

2. A fire-resistant fabric according to claim 1 wherein the intumescent coating comprises a carbonific compound, a catalyst and a source of a non-flammable gas.

3. A fire-resistant fabric according to claim 1 wherein the intumescent coating layer is frothed and is applied at a rate of from about 0.2 to 20 ounces per square yard.

4. A fire-resistant fabric according to claim 3 wherein the intumescent coating layer has an air permeability of from about 1 to 300 cubic feet per minute.

5. A fire-resistant fabric according to claim 4 wherein the intumescent coating layer has an air permeability of from about 2 to 80 cubic feet per minute.

6. A fire-resistant fabric according to claim 5 wherein the intumescent coating layer has an air permeability of from about 10 to 30 cubic feet per minute.

7. A fire-resistant fabric according to claim 1 wherein the filament of said core is fiberglass and wherein the staple fibers of said sheath are selected from the group consisting of cotton, polyester, rayon, wool, nylon, acrylic, modacrylic, acetate and blends thereof.

8. A fire-resistant fabric according to claim 1 wherein the textile fabric substrate is of a knitted construction.

9. A fire-resistant fabric according to claim 1 wherein the textile fabric substrate is of a woven construction.

10. A fire-resistant fabric according to claim 1 wherein a reflective flame durable paint coating is carried by the opposite surface of said textile fabric.

11. A fire-resistant fabric according to claim 10 wherein said reflective paint coating comprises a reflective metallic paint.

12. A fire-resistant fabric according to claim 11 wherein said reflective metallic paint comprises metal flake pigments and a flame durable silicone alkyd resin binder.

13. An article of manufacture comprising the fire-resistant fabric of claim 1, said article selected from the group consisting of upholstered articles, office building materials, bedroom articles, draperies, tents, awnings, field fire shelters and sleeping bag covers.

14. A fire-resistant fabric suitable for use as a flame barrier, and comprising: a flame durable knitted textile substrate formed of intermeshed corespun yarns, said yarns comprising a core of a flame resistant fiberglass filament and a sheath of staple fibers, and an intumescent coating comprising a carbonific compound, a catalyst and a source of non-flammable gas, said intumescent coating carried by one surface of said textile fabric substrate.

15. A fire-resistant fabric according to claim 14 wherein the intumescent coating layer is applied at a rate of from about 0.2 to 20 ounces per square yard.

16. A fire-resistant fabric according to claim 14 wherein the intumescent coating layer has an air permeability of from about 1 to 300 cubic feet per minute.

17. A fire-resistant fabric according to claim 16 wherein the intumescent coating layer has an air permeability of from about 2 to 80 cubic feet per minute.

18. A fire-resistant fabric according to claim 17 wherein the intumescent coating layer has an air permeability of from about 10 to 30 cubic feet per minute.

19. A fire-resistant fabric according to claim 14 wherein the staple fibers of said sheath are selected from the group consisting of cotton, polyester, rayon, wool, nylon, acrylic, modacrylic, acetate and blends thereof.

20. A fire-resistant fabric according to claim 14 wherein a reflective flame durable paint coating is carried by the opposite surface of said textile fabric.

21. A fire-resistant fabric according to claim 20 wherein said reflective paint coating comprises a reflective metallic paint.

22. A fire-resistant fabric according to claim 21 wherein said reflective metallic paint comprises metal flake pigments and a flame durable silicone alkyd resin binder.

23. An article of manufacture comprising the fire-resistant fabric of claim 14, said article selected from the group consisting of upholstered articles, office building materials, bedroom articles, draperies, tents, awnings, field fire shelters and sleeping bag covers.

24. A fire resistant laminate comprising an underlying flammable layer, a flame barrier fabric overlying said flammable layer, said flame barrier fabric comprising a flame durable knitted textile fabric substrate formed of intermeshed corespun yarns, said yarns comprising a core of a flame resistant fiberglass filament and a sheath of staple fibers, an intumescent coating carried by one surface of said knitted textile fabric, and a decorative surface fabric overlying said flame barrier fabric, said intumescent coating contacting the decorative surface fabric layer.

25. A fire-resistant fabric according to claim 24 wherein the intumescent coating comprises a carbonific compound, a catalyst and a source of a non-flammable gas.

26. A fire-resistant fabric according to claim 24 wherein the intumescent coating layer is applied at a rate of from about 0.2 to 20 ounces per square yard.

27. A fire-resistant fabric according to claim 26 wherein the intumescent coating layer has an air permeability of from about 1 to 300 cubic feet per minute.

28. A fire-resistant fabric according to claim 27 wherein the intumescent coating layer has an air permeability of from about 2 to 80 cubic feet per minute.

29. A fire-resistant fabric according to claim 28 wherein the intumescent coating layer has an air permeability of from about 10 to 30 cubic feet per minute.

30. A fire-resistant fabric according to claim 24 wherein the staple fibers of said sheath are selected from the group consisting of cotton, polyester, rayon, wool, nylon, acrylic, modacrylic, acetate and blends thereof.

31. A fire-resistant laminate according to claim 24 wherein a reflective paint coating is carried by the back surface of said knitted textile fabric and contacts the underlying flammable layer.

32. A fire-resistant fabric according to claim 31 wherein said reflective paint coating comprises a reflective metallic paint.

33. A fire-resistant fabric according to claim 32 wherein said reflective metallic paint comprises metal flake pigments and a flame durable silicone alkyd resin binder.

34. A fire-resistant laminate according to claim 24 wherein the underlying flammable layer comprises a polyurethane foam.

35. A method of producing a fire-resistant fabric suitable for use as a flame barrier, said method comprising:

(a) forming a flame durable textile fabric substrate from corespun yarns having a core of a flame resistant filament and a sheath of staple fibers, (b) applying to one surface of the textile fabric substrate an intumescent coating comprising a carbonific compound, a catalyst and a source of a non-flammable gas, and (c) curing the coating to produce a fire-resistant fabric.

36. A method according to claim 35 wherein said step of applying the intumescent coating includes frothing the coating.

37. A method according to claim 35 wherein said step of applying the intumescent coating is performed at a rate of from about 0.2 to 20 ounces per square yard.

38. A method according to claim 35 additionally including the step of applying a reflective flame durable metallic paint coating to the surface of the textile fabric substrate opposite the intumescent coating.

39. A method of producing a fire-resistant laminate comprising:

(a) forming a flame durable textile fabric substrate from corespun yarns having a core of a flame resistant filament and a sheath of staple fibers, (b) applying to one surface of the textile fabric substrate an intumescent coating comprising a carbonific compound, a catalyst and a source of a non-flammable gas, and (c) bonding a decorative surface fabric to the textile fabric substrate, the intumescent coating contacting the decorative outer fabric.

40. A method according to claim 39 wherein said step of bonding a decorative surface fabric to the textile fabric substrate includes partially curing the intumescent coating and fusion bonding the textile fabric substrate and the decorative surface fabric together.

41. A method according to claim 39 wherein said step of applying the intumescent coating includes frothing the coating.

42. A method according to claim 39 wherein said step of applying the intumescent coating is performed at a rate of from about 0.2 to 20 ounces per square yard.

43. A method according to claim 39 including the additional step of bonding a flammable layer to the opposite surface of the textile fabric substrate.

* * * * *